US009890965B2

(12) United States Patent
Holland et al.

(10) Patent No.: US 9,890,965 B2
(45) **Date of Patent: *Feb. 13, 2018**

(54) ROOF RIDGE VENT AND VENTILATED ROOF EMPLOYING SAME

(71) Applicant: AIR VENT, INC., Dallas, TX (US)

(72) Inventors: Robert Bradley Holland, Rowlett, TX (US); Andrew Frederick Lindahl, Plano, TX (US)

(73) Assignee: Air Vent, Inc., Dallas, TX (US)

( * ) Notice: Subject to any disclaimer, the term of this patent is extended or adjusted under 35 U.S.C. 154(b) by 826 days.

This patent is subject to a terminal disclaimer.

(21) Appl. No.: 14/309,353

(22) Filed: Jun. 19, 2014

(65) Prior Publication Data

US 2014/0308891 A1 Oct. 16, 2014

Related U.S. Application Data

(63) Continuation-in-part of application No. 12/701,834, filed on Feb. 8, 2010, now Pat. No. 8,790,167.

(51) Int. Cl.
*F24F 7/02* (2006.01)
*E04D 13/17* (2006.01)

(52) U.S. Cl.
CPC ..... *F24F 7/02* (2013.01); *E04D 13/174* (2013.01)

(58) Field of Classification Search
CPC ..... E04D 13/174; F24F 7/02
See application file for complete search history.

(56) References Cited

U.S. PATENT DOCUMENTS 4,558,637 A * 12/1985 Mason ..... E04D 1/3402 454/365
4,573,291 A * 3/1986 Hofmann ..... E04D 1/3402 52/43

(Continued)

FOREIGN PATENT DOCUMENTS

CA 2142804 8/1995
DE 44 04166 A1 8/1995

(Continued)

OTHER PUBLICATIONS

"Dentil Trim", 2008 The Tapco Group, A Headwaters Company, http:/www.midamericabuilding.com/_architects/roofing/roofing.php.

(Continued)

*Primary Examiner* — Steven B McAllister
*Assistant Examiner* — Jonathan Cotov
(74) *Attorney, Agent, or Firm* — Eckert Seamans Cherin & Mellott, LLC; Grant E. Coffield; John P. Powers

(57) ABSTRACT

A vent for a roof includes a body having an inner surface facing the roof, an outer surface, first and second opposing ends and first and second opposing sides. First and second edge portions are disposed at or about the first and second sides, respectively, and include a plurality of openings for the passage of air. A plurality of protrusions extend outwardly from the inner surface of the body. A plurality of elongated resilient members extend longitudinally between the first and second ends of the body and cooperate with the protrusions. At least a portion of each of the elongated resilient members extends beyond a bottom edge of the vent and is compressed against the exterior surface of the roof, in order to substantially fill in and seal spaces between the exterior surface of the roof and the at least one vent.

20 Claims, 6 Drawing Sheets

(56) References Cited

U.S. PATENT DOCUMENTS 4,642,958 A * 2/1987 Pewitt ..... E04D 3/40 454/250
4,660,463 A * 4/1987 Bottomore ..... E04D 13/178 454/260
4,773,310 A * 9/1988 Corwin ..... F24F 7/013 454/210
4,924,761 A 5/1990 MacLeod et al.
5,009,149 A * 4/1991 MacLeod ..... E04D 13/174 454/365
5,050,489 A * 9/1991 Mankowski ..... F24F 7/02 454/365
5,052,286 A * 10/1991 Tubbesing ..... F24F 7/02 454/365
5,060,431 A * 10/1991 MacLeod ..... F24F 7/02 454/250
5,122,095 A 6/1992 Wolfert
5,174,076 A * 12/1992 Schiedegger ..... F24F 7/02 454/3
5,458,538 A * 10/1995 MacLeod ..... E04D 13/174 454/365
5,593,348 A * 1/1997 Rickert ..... E04D 1/36 454/365
5,651,734 A * 7/1997 Morris ..... E04D 1/36 454/365
5,803,805 A * 9/1998 Sells ..... F24F 7/02 454/260
5,924,925 A * 7/1999 Nystrom ..... E04D 3/40 454/365
5,971,848 A * 10/1999 Nair ..... F24F 7/02 454/365
6,164,021 A * 12/2000 Huber ..... E04D 1/3402 52/309.13
6,227,963 B1 * 5/2001 Headrick ..... F24F 7/02 454/365
6,308,472 B1 * 10/2001 Coulton ..... E04D 13/176 428/906
6,371,847 B2 * 4/2002 Headrick ..... F24F 7/02 454/365
6,418,692 B1 * 7/2002 Freshwater ..... E04D 1/30 52/199
6,491,581 B1 * 12/2002 Mankowski ..... E04D 13/174 454/365
6,530,189 B2 * 3/2003 Freshwater ..... E04D 1/30 52/199
6,598,356 B1 * 7/2003 Sells ..... E04D 13/174 52/198
6,599,184 B2 * 7/2003 Morris ..... E04D 13/174 454/365
6,662,509 B2 * 12/2003 Sharp ..... E04D 13/174 454/250
6,793,574 B1 * 9/2004 Robinson ..... E04D 13/174 454/364
6,814,772 B1 * 11/2004 Wake ..... F02M 35/0203 123/198 E
6,881,144 B2 * 4/2005 Hansen ..... E04D 13/176 454/365
6,913,530 B2 * 7/2005 Morris ..... E04D 13/176 454/365
6,991,535 B2 * 1/2006 Ciepliski ..... E04D 13/176 454/365
7,219,473 B2 * 5/2007 Mantyla ..... E04D 13/174 454/250
7,527,554 B2 * 5/2009 Schmid ..... E04D 1/365 454/365
7,562,498 B2 * 7/2009 Galeazzo ..... F24F 7/02 454/365
7,766,735 B2 * 8/2010 Ciepliski ..... E04D 13/174 454/365
7,805,889 B2 * 10/2010 Barnett ..... E04D 13/076 52/12
8,024,897 B2 * 9/2011 Polumbus ..... E04D 13/174 52/198
8,069,621 B2 * 12/2011 Mantyla ..... E04D 13/174 454/250
8,157,628 B2 * 4/2012 Villela ..... F24F 7/02 454/365
8,292,707 B2 * 10/2012 Grisham ..... E04D 13/17 454/260
8,302,352 B2 * 11/2012 Bahn ..... E04D 13/174 52/199
2005/0054284 A1 * 3/2005 Ciepliski ..... E04D 13/176 454/365
2005/0241248 A1 * 11/2005 Ridenour ..... E04D 13/174 52/198
2005/0246972 A1 * 11/2005 Polumbus ..... E04D 13/174 52/90.1
2006/0116069 A1 * 6/2006 Urbanski ..... E04D 13/174 454/365
2008/0287053 A1 * 11/2008 Carlson ..... E04D 13/174 454/365
2008/0287054 A1 * 11/2008 Carlson ..... E04D 13/174 454/365
2009/0130969 A1 5/2009 Grisham et al.
2010/0112932 A1 * 5/2010 Grubka ..... E04D 13/174 454/365
2010/0144266 A1 * 6/2010 Lowe ..... F24F 7/02 454/365
2013/0023197 A1 * 1/2013 Grisham ..... F24F 7/02 454/260

FOREIGN PATENT DOCUMENTS

DE 44 14211 A1 10/1995
JP 11-350667 12/1999
JP 2003-166322 6/2003

OTHER PUBLICATIONS

"Ridge Vents, Ridge Masters, Hip Masters", Ridge Vents, Ridge Master, Hip Master Roof Ventilation, 2009 Tapco Europe Ltd., http://www.tapcoeurope.com/ridgevents.htm.
"Cor-A-Vent V-300 Ridge Ventilation System", Cor-A-Vent : V-300, http://www.cor-a-yent.com/v300.cfm.

* cited by examiner 122
110
300
118
132
128
116
138
136
126
120
142
140
128
114
144
130
106
150
146
148
104
108
134
112
102

118
110
122
114
120
116
102
104
108
134
112
106

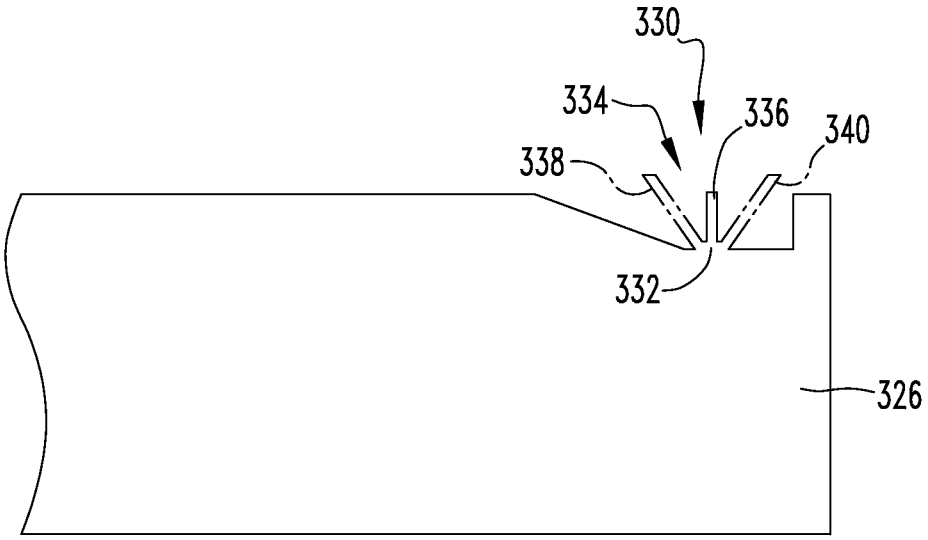
FIG.10 102′
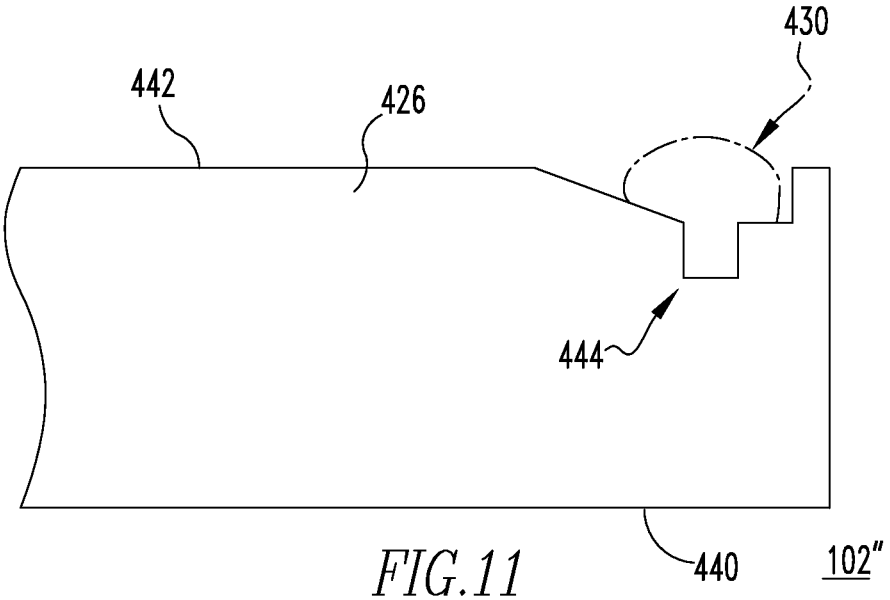
FIG.11 102″

ROOF RIDGE VENT AND VENTILATED ROOF EMPLOYING SAME

CROSS REFERENCE TO RELATED APPLICATION

This application is a continuation-in-part application of and claims priority to U.S. patent application Ser. No. 12/701,834, filed Feb. 8, 2010, entitled ROOF RIDGE VENT AND VENTILATED ROOF EMPLOYING SAME.

BACKGROUND

Field

The disclosed concept relates generally to vents and, more particularly, to roof ridge vents for ventilating the roof of a structure such as, for example, a building. The disclosed concept also relates to ventilated roofs employing ridge vents.

Background Information

Vents are commonly employed on the roofs of structures, such as residential buildings, commercial buildings and other structures, in order to exhaust air from beneath the roof (e.g., from an attic space) into the surrounding atmosphere, and to remove moisture.

For example, a variety of passive roof vents have been employed at various locations on building roofs in an attempt to release heat which can undesirably build up and become trapped under the roof. Passive vents provide an air passageway for such hot air to be exhausted from the roof, and thereby help to maintain a relatively comfortable temperature within the building. More specifically, by releasing unwanted hot air, a lower average temperature can be maintained without requiring excessive energy to be expended to cool the air, for example, by air-conditioning. The vents serve to stimulate natural convection of the air by releasing the hot air which has risen to the roof and, in turn, drawing and circulating cooler air, which is more dense and thus resides in relatively low-lying areas, throughout the building. Such vents also serve a safety function, as excessive heat can result in damage to the roof, and could potentially cause a fire. This is particularly important in warm climates where the roof is exposed to excessive and prolonged heat and sunlight. In cooler climates, venting the attic space serves to exhaust undesirable moisture-laden attic air, in order to prevent damage to the internal structure. It will be appreciated, therefore, that roof vents not only function to eradicate unwanted heat and/or moisture from the roof assembly, but in doing so, also extend the life of the roof assembly and, in particular, roof shingles (e.g., without limitation, asphalt shingles).

FIGS. 1 and 2 show an example of a ridge vent 2, which is employed at the peak or ridgeline 4 of the roof 6 of a building 8, as partially shown in FIG. 1. The ridge vent 2 generally includes a resilient elongated body 10 having first and second opposing sides 12,14 and opposing lateral edges 16,18. As shown in FIG. 1, the first side 12 is structured to overlay an exterior surface (e.g., without limitation, shingles 20) at or about the roof ridgeline 4, and the second side 14 is structured to be covered by a plurality of finishing shingles 22. The ridge vent 2 facilitates the aforementioned passive ventilation by providing passageways 24,26 at the lateral edges 16,18, respectively, as well as passageways 28,30 at the longitudinal ends 32,34, respectively, of the ridge vent 2, through which air can circulate, as desired. In the non-limiting example of FIGS. 1 and 2, the passageways 24,26 at the lateral edges 16,18 of the ridge vent 2 are a plurality of closely spaced slots 24,26, and the passageways 28,30 at the longitudinal ends 32,34 of the ridge vent 2 are formed by a predetermined arrangement of generally V-shaped members 36,38 (best shown in FIG. 2). Upturned shields or baffle members 40,42 extend upwardly at the lateral edges 16,18, respectively, to at least partially shield, and/or create a baffle for, the slots 24,26.

Generally, such ridge vents 2 have been effective for ventilating traditional gable style roofs 6 of the type shown in FIG. 1. As shown in FIG. 1, a gable style roof 6 has a substantially straight ridgeline 4 that runs the entire length of the roof 6 at substantially the same elevation, all the way to the edge of the building 8, or slightly beyond the edge of the building 8. The upper course of shingles 20, near the peak 4 of the roof 6, provides a relatively smooth and flat surface for the ridge vent 2 to mount and conform to. However, a hip roof 44 of the type shown for example in FIG. 3, often presents a stair or stepped surface with which the ridge vent 2 must interface. Specifically, unlike the aforementioned gable roof 6 (FIG. 1), the hip roof 44 has hip ends 46,48,50 which slope backwards and can result in a plurality of ridgelines 52,54,56 being formed at different elevations. Consequently, a sloped ridgeline transition section is required between the ridgelines. For example, sloped ridgeline transition section 58 transitions from ridgeline 54 to ridgeline 56, and sloped ridgeline transition section 60 transitions from ridgeline 52 to ridgeline 56. These sloped areas of the hip roof 44 create the aforementioned stair or stepped surfaces, which are not conducive for traditional roof ridge vent designs. That is, use of conventional ridge vents 2 over such stair or stepped surfaces results in gaps between the base (e.g., first side 12) of the vent 2 and the roof shingles (e.g., shingles 20). In order to resist weather and/or debris from entering through such gaps, extreme care must be used to close them, for example, using roofing sealants.

There is, therefore, room for improvement in roof ridge vents.

SUMMARY

These needs and others are met by embodiments of the disclosed concept, which are directed to a roof ridge vent including a number of elongated resilient members structured to provide an effective seal between the vent and exterior surface (e.g., without limitation, roof shingles), even in locations where the shingles form a stair or stepped surface.

As one aspect of the disclosed concept, a vent is provided for a roof. The roof includes an exterior surface. The vent comprises: a body comprising an inner surface structured to face the roof, an outer surface disposed opposite the inner surface, a first end, a second end disposed opposite and distal from the first end, a first side, and a second side disposed opposite and distal from the first side; a first edge portion disposed at or about the first side and including a plurality of first openings for the passage of air; a second edge portion disposed at or about the second side and including plurality of second openings for the passage of air; a plurality of protrusions extending outwardly from the inner surface of the body; and a plurality of elongated resilient members extending longitudinally between the first end and the second end, each of the elongated resilient members cooperating with a corresponding number of the protrusions. The elongated resilient members are structured to compress against the exterior surface of the roof, thereby forming a seal between the vent and the roof.

The body may further comprise a bottom edge. At least a portion of each of the elongated resilient members may extend beyond the bottom edge, in order to substantially fill in and seal spaces between the exterior surface of the roof and the vent.

As another aspect of the disclosed concept, a ventilated roof comprises: a substructure including a substantially flat layer; at least one ridgeline including a ventilation opening; a plurality of shingles attached to the substantially flat layer; and at least one vent overlaying the ventilation opening, the at least one vent comprising: a body comprising an inner surface facing the shingles, an outer surface disposed opposite the inner surface, a first end, a second end disposed opposite and distal from the first end, a first side, and a second side disposed opposite and distal from the first side, a first edge portion disposed at or about the first side and including a plurality of first openings for the passage of air, a second edge portion disposed at or about the second side and including plurality of second openings for the passage of air, a plurality of protrusions extending outwardly from the inner surface of the body, and a plurality of elongated resilient members extending longitudinally between the first end and the second end, each of the elongated resilient members cooperating with a corresponding number of the protrusions. The elongated resilient members compress against the shingles, thereby forming a seal between the shingles and the at least one vent.

The protrusions of the at least one vent may be a plurality of transverse supporting members, wherein each of the transverse supporting members includes an inner edge disposed at or about the inner surface of the body of the at least one vent, and an outer edge disposed opposite the inner edge. The inner edge may include a cutout, and each of the elongated resilient members of the at least one vent may comprise a separate member including a mounting portion and a sealing portion. The mounting portion may be disposed in the cutout, and the sealing portion may extend outwardly from the mounting portion toward the roof. The sealing portion may comprise a plurality of sealing projections, wherein each of the sealing projections extends outwardly from the mounting portion and compresses against the shingles of the roof, in order to substantially fill in and seal spaces between the shingles and the at least one vent.

Each of the elongated resilient members may be a dual durometer component, wherein the mounting portion is generally hard and the sealing portion is generally soft. The vent may further comprise a filter element. The filter element may be disposed between the elongated resilient elements and the inner surface of the body of the vent.

BRIEF DESCRIPTION OF THE DRAWINGS

A full understanding of the disclosed concept can be gained from the following description of the preferred embodiments when read in conjunction with the accompanying drawings in which:

FIG. 10 is an enlarged side elevation view of a portion of a protrusion and elongated resilient member of a vent, in accordance with another embodiment of the disclosed concept; and FIG. 11 is an enlarged side elevation view of a portion of a protrusion and sealing member of a vent, in accordance with a further embodiment of the disclosed concept.

DESCRIPTION OF THE PREFERRED EMBODIMENTS

Figure 1:
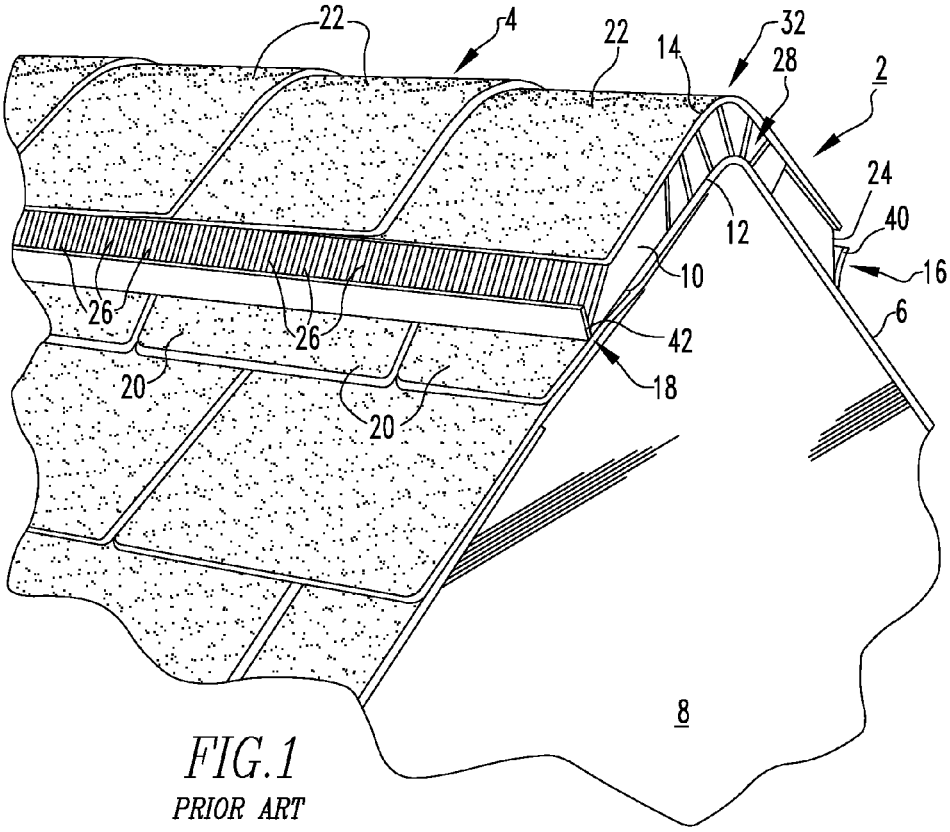
FIG.1 PRIOR ART
FIG. 1 is an isometric view of a portion of a gable style roof and conventional ridge vent therefor.

For purposes of illustration, embodiments of the disclosed concept will be shown and described as applied to ventilation of hip style roofs, although it will become apparent that they could also be applied to ventilate any other known or suitable type of roof (e.g., without limitation, gable style roofs; roofs having a combination of hips and gables).

Directional phrases used herein, such as, for example, up, down, top, bottom and derivatives thereof, relate to the orientation of the elements shown in the drawings and are not limiting upon the claims unless expressly recited therein.

The specific elements illustrated in the drawings and described herein are simply exemplary embodiments of the disclosed concept. Accordingly, specific dimensions, orientations and other physical characteristics related to the embodiments disclosed herein are not to be considered limiting on the scope of the disclosed concept.

As employed herein, the terms "gable," "gable roof," "gable type," and "gable style" refer to a roof structure for a building or other structure wherein the peak or ridgeline of the roof extends to the edge of the building, or slightly beyond the edge.

As employed herein, the terms "hip," "hip roof," "hip type" and "hip style" refer to a roof structure for a building or other structure wherein the peak or ridgeline of the roof does not extend to the edge of the building, but rather stops short of the edge of the building and, therefore, includes a plurality of sloped portions.

As employed herein, the term "shingle" refers to any known or suitable type of roof finishing layer, expressly including, but not limited to asphalt shingles, slate shingles, as well as shingles made from any other known or suitable synthetic material.

As employed herein, the term "durometer" is used in its traditional sense to refer to the relative hardness or softness (e.g., without limitation, resiliency; elasticity; compressibility) of the material (e.g., without limitation, rubber) from which a component is made. Accordingly, a "dual durometer" component in accordance with the disclosed concept is one having a first portion with first hardness or softness, and a second portion with a second, different hardness or softness.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figures 4, 5:
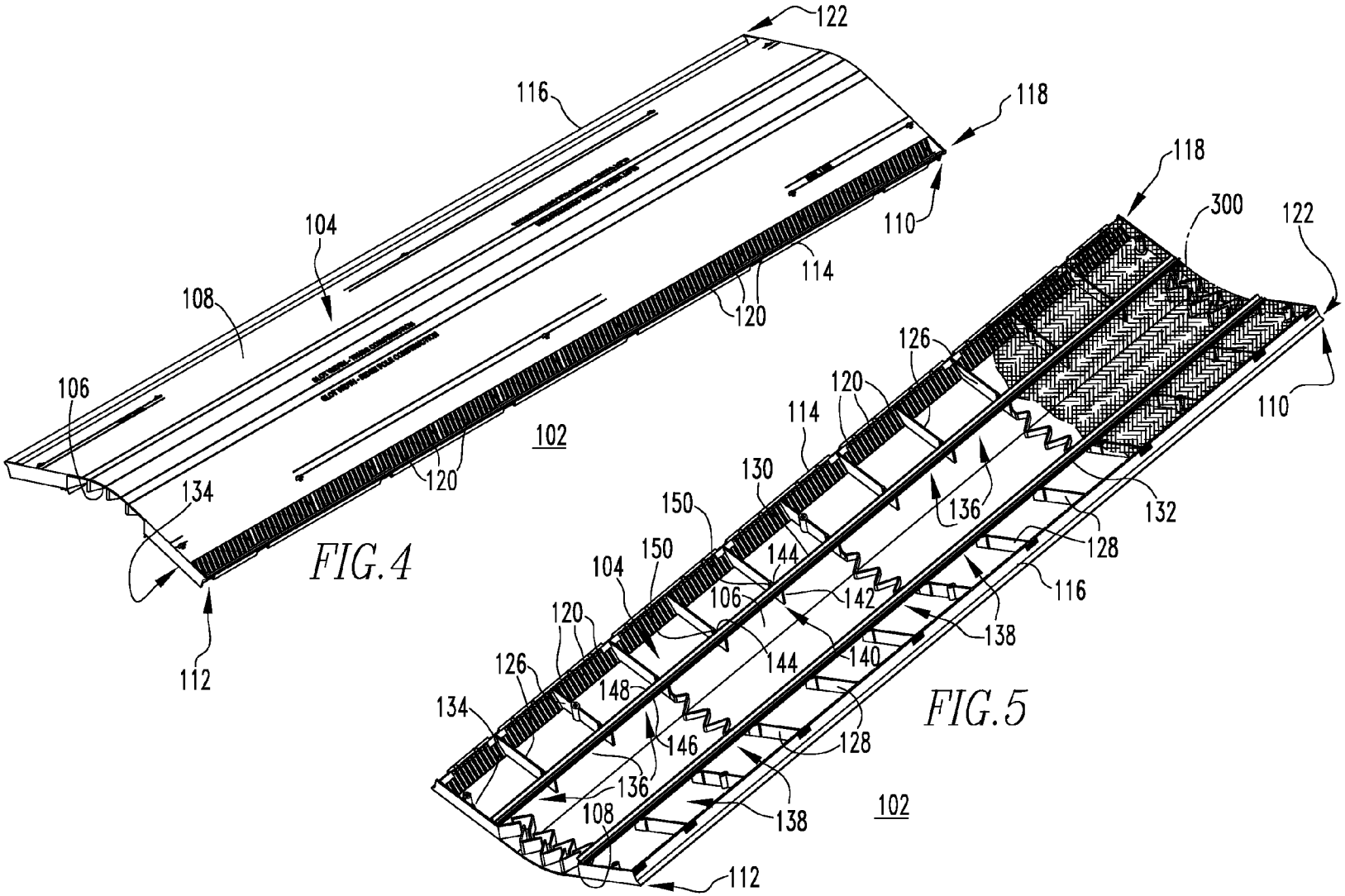
FIG. 4 is a top isometric view of a roof ridge vent in accordance with an embodiment of the disclosed concept.
FIG. 5 is a bottom isometric view of the vent of FIG. 4.
Figure 8:
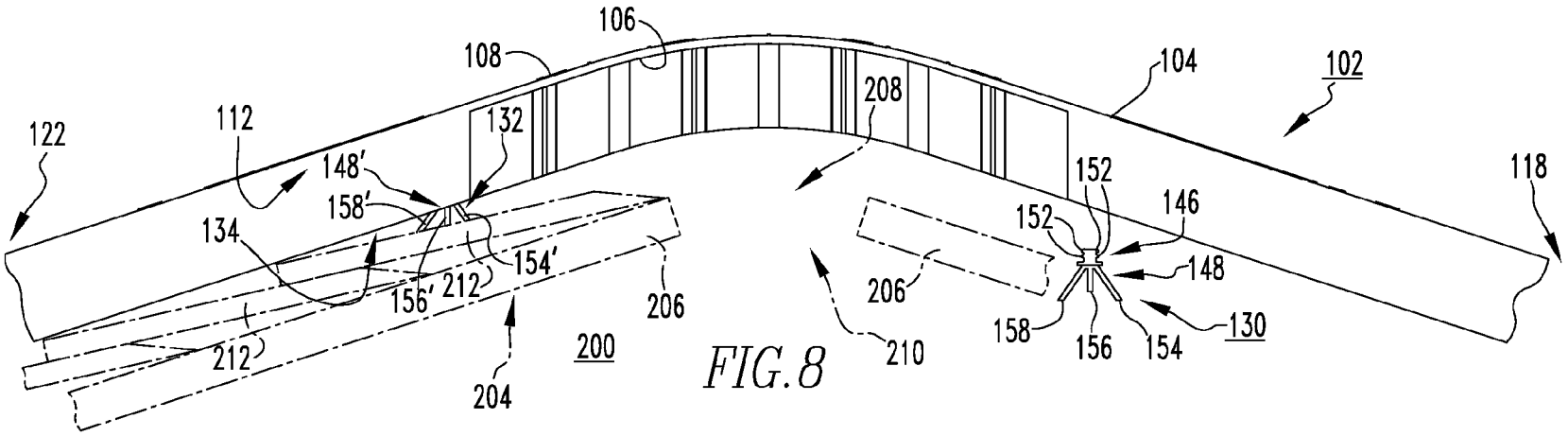
FIG. 8 is a partially exploded end elevation view of the vent of FIG. 6, also showing a portion of a ventilated roof in accordance with an embodiment of the disclosed concept.
Figure 9:
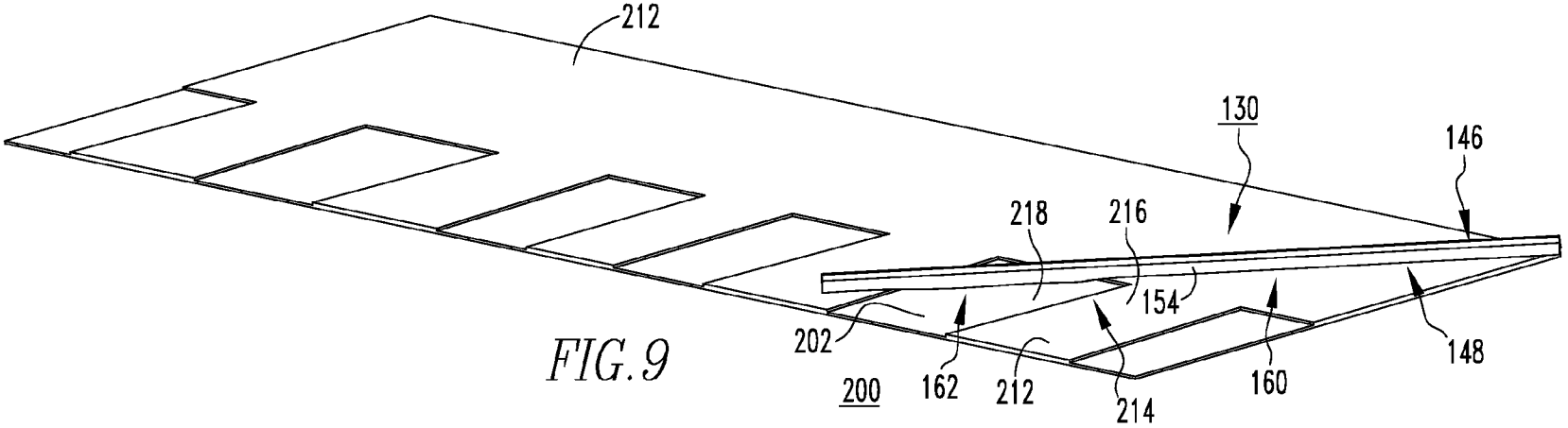
FIG. 9 is an isometric view of a portion of a roof showing an elongated resilient member of the vent sealing an uneven (e.g., without limitation, stepped) surface of a roof shingle, in accordance with an embodiment of the disclosed concept.

FIGS. 4 and 5 show top and bottom isometric views, respectively, of a vent 102 for ventilating a roof 200 (partially shown in simplified form in phantom line drawing in FIG. 8; see also FIG. 9) in accordance with the disclosed concept. Specifically, as shown in FIG. 8, the vent 102 cooperates with (e.g., is disposed over) the exterior surface 202 of the roof 200, wherein the roof 200 generally includes a substructure 204 having a substantially flat layer 206, which may be formed, for example and without limitation, from plywood or any other known or suitable substantially flat material. The vent 102 is disposed at a ridgeline 208 of the roof 200, where a ventilation opening 210 is provided. More specifically, a plurality of shingles 212 are suitably attached to the substantially flat layer 206 of the roof 200, and the vent 102 overlays the ventilation opening 210 such that the vent 102 engages the exterior surface 202 of the roof shingles 212 on either side of the ventilation opening 210. The roof structures (e.g., without limitation, substructure 204; substantially flat layer 206; ridgeline 208; ventilation opening 210; shingles 212) are only partially shown in simplified form in phantom line drawing for simplicity of illustration and economy of disclosure.

Figure 6:
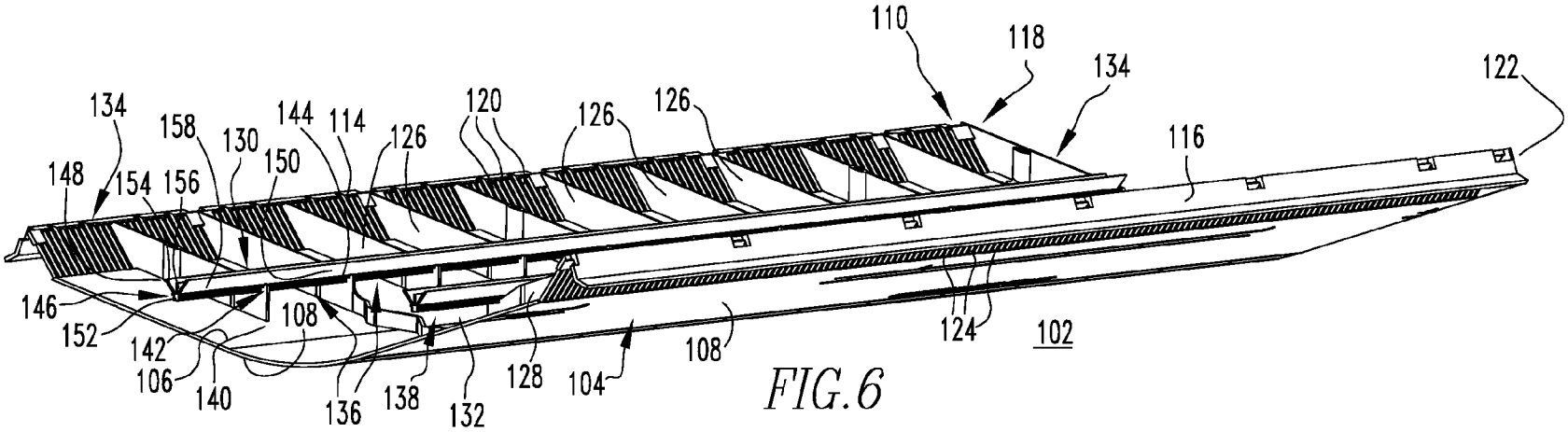
FIG. 6 is an isometric view of a cutaway portion of the vent of FIG. 5.

Referring again to FIGS. 4 and 5, as well as FIG. 6, the vent 102 includes a body 104 having an inner surface 106, which is structured to face the roof 200 (FIG. 8), and an outer surface 108, which is disposed opposite the inner surface 106. The vent 102 further includes first and second opposing ends 110,112 (both shown in FIGS. 4 and 5), and opposing first and second sides 114,116. A first edge portion 118, which is disposed at or about the first side 114, includes a plurality of first openings 120 for the passage of air. A second edge portion 122, which is substantially similar to the first edge portion 118 and is disposed at or about the second side 116 of the vent 102, includes a plurality of second openings 124 (FIG. 6) for the passage of air.

A plurality of protrusions 126,128 (described in greater detail hereinbelow) extend outwardly from the inner surface 106 of the vent body 104, and a plurality of elongated resilient members 130,132 (two are shown) extend longitudinally between the first end 110 and the second end 112 of the vent body 104, as shown in FIGS. 5 and 6. As will be described in greater detail hereinbelow, the elongated resilient members 130,132 are structured to compress against the exterior surface 202 of the roof 200, as shown in FIGS. 8 and 9, thereby forming a seal between the vent 102 and the roof 200. More specifically, as best shown in the end elevation view of FIG. 8, each of the elongated resilient members 130,132 preferably extends beyond the bottom edge 134 of the vent body 104 (see, for example, elongated resilient member 132 of FIG. 8; elongated resilient member 130 is shown exploded away from the vent 102 in FIG. 8 for purposes of illustration), prior to being installed on the roof 200. In this manner, the elongated resilient members 130, 132 function to substantially fill in and seal spaces or voids between the exterior surface 202 of the roof 200 and the vent 102. It will, however, be appreciated that the elongated resilient members 130,132 are preferably sufficiently resilient (e.g., compressible) and/or a sufficient relief area 170 (FIG. 7) is provided in the protrusions 126,128 that, when the vent 102 is installed on the roof 200, the elongated resilient members 130,132 are compressed upwardly (from the perspective of FIG. 8) so that the vent 102 may lay flat (e.g., flush) against the exterior surface 202 of the roof 200. That is, when the vent 102 is installed on the roof 200, it is not a requirement of the disclosed concept that the elongated resilient members 130,132 continue to extend below the bottom edge 134 of the vent body 104, as is the case prior to installation on the roof 200, and as shown in the non-limiting example of FIG. 8.

The structure of the vent 102 will now be described in greater detail. Specifically, as best shown in FIG. 5, the aforementioned protrusions 126,128 of the example vent 102 include a first number of protrusions 126, which extend laterally inwardly from the first edge portion 118 of a vent body 104 toward the second edge portion 122, and a second number of protrusions 128, which extend laterally inwardly in the opposite direction, from the second edge portion 122 toward the first edge portion 118. In other words, the protrusions preferably comprise a plurality of transverse supporting members 126,128, which extend downward from the inner surface 106 of the vent body 104. Each of the elongated resilient members 130,132 extends perpendicularly across a corresponding one of the first number of protrusions 126 and the second number of protrusions 128. More specifically, the example vent 102 includes a first elongated resilient member 130, which extends longitudinally across the first number of protrusions 126, and a second elongated resilient member 132, which extends longitudinally across the second number of protrusions 128, substantially parallel with respect to the first elongated resilient member 130. Thus, when the vent 102 is installed on the roof 200, as partially shown in simplified form in FIG. 8, the first elongated resilient member 130 forms a seal on one side of the roof ridgeline 210, and the second elongated resilient member 132 forms a seal on the other side of the roof ridgeline 210, as shown.

As shown with reference to the cutaway vent segment of FIG. 6, when the first elongated resilient member 130 is disposed on the first number of protrusions 126, it is spaced from the inner surface 106 of the vent body 104, thereby forming a number of first gaps 136 between the inner surface 106 and elongated resilient member 130. The first gaps 136 enable airflow to the plurality of first openings 120 disposed at the first edge portion 118 of the vent 102. Similarly, when the second elongated resilient member 130 is disposed on the second number of protrusions 128, it is spaced from the inner surface 106 of the vent body 104 to form a number of second gaps 138, which enable airflow to the plurality of second openings 124 at the second edge portion 122 of the vent 102 (see also first and second gaps 136,138 beneath first and second elongated resilient members 130,132, respectively, in FIG. 5).

In the example shown and described herein, the elongated resilient elements 130,132 are separate members which are structured to be coupled to the protrusions 126,128, respectively, of the vent 102. It will, however, be appreciated that they could alternatively form an integral part of the vent 102, for example and without limitation, by being molded as an integral feature of the vent body 104, without departing from the scope of the disclosed concept. Among the benefits of the elongated resilient elements 130,132 comprising separate components that are subsequently coupled to the vent 102, is the fact that they can be relatively easily replaced or exchanged. For example and without limitation, the potential exists for a wide variety of different elongated resilient elements (e.g., 130,132) having any known or suitable alternative shape, configuration and/or material properties (not shown) other than those which are shown and described herein. In this manner, the vent 102 could be readily adapted for use in a wide variety of different roofing applications (e.g., without limitation, different positions on the roof; different roof types (e.g., without limitation, hip roof; gable roof); different types of finishing surface (e.g., without limitation, shingles)).

The manner in which the exemplary elongated resilient members 130,132 are coupled to the vent 102 will now be described in greater detail. Specifically, each of the aforementioned protrusions or transverse supporting members 126,128 includes an inner edge 140 disposed at or about the inner surface 106 of the vent body 104, and an outer edge 142 disposed opposite the inner edge 140. The outer edges 142 of at least some of the transverse supporting members 126,128 include a cutout 144 (see also FIG. 7). For simplicity of illustration and economy of disclosure, only the first number of protrusions or transverse supporting member 126 will be described, in detail, herein. It will be appreciated that the second number of protrusions or transverse supporting members 128 are substantially similar. Specifically, the example elongated resilient members 130,132 each include a mounting portion 146 and a sealing portion 148. As shown in FIGS. 5 and 6, the mounting portion 146 is disposed in the corresponding cutouts 144 of the protrusions 126, and the sealing portion 148 extends outwardly form the mounting portion 146 toward the roof 200 (see, for example, FIG. 8). The cutouts 144 of the protrusions or transverse supporting members 126 are aligned, such that they collectively form a channel 150 for receiving the corresponding elongated resilient element 130. To help secure the elongated resilient member 130 and, in particular the mounting portion 146 thereof, within the corresponding channel 150, the mounting portion 146 preferably includes a plurality of resilient ribs 152 (best shown in the partially exploded view of FIG. 8). It will be appreciated that, when the mounting portion 146 is disposed in the channel 150, the resilient ribs 152 compress against the transverse supporting members 126 within the cutouts 144 thereof, thereby securely coupling the elongated resilient member 130 to the vent body 104 by way of an interference fit. It will, however, be appreciated that any known or suitable alternative manner or mechanism (not shown) of suitably securing the elongated resilient members 130,132 to the vent 102 could be employed, without departing from the scope of the disclosed concept.

Figure 7:
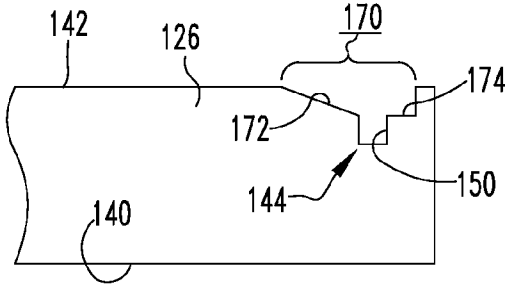
FIG. 7 is an enlarged side elevation view of a portion of one of the protrusions or supporting members of the vent, showing the cutout therein for receiving an elongated resilient member in accordance with an embodiment of the disclosed concept.

It will also be appreciated that the cutouts 144 in the outer edges 142 of the projections 126 preferably further include a relief area 170, as shown in FIG. 7. In the example of FIG. 7, the relief area 170 includes a first, tapered relief portion 172 disposed on one side of the channel 150, and a second relief portion 174 disposed on the other side of the channel 150. Together these relief portions 172,174 provide sufficient relief area 170 for the corresponding elongated resilient element 130 (FIGS. 6, 8 and 9) to be received (e.g., without limitation, compressed within) such that the bottom edge 134 of the vent body 104 can lay flush against the exterior surface 202 of the roof 200 when the vent 102 is installed.

It will be further appreciated that the vent 102 may, but need not necessarily, be employed with a suitable filter element 300, as partially shown in phantom line drawing in FIG. 5. In view of the aforementioned manner in which the example resilient elongated members 130,132 are coupled to the vent body 104 and, in particular, to the projections or transverse supporting members 126,128 thereof, the potential exists for the elongated supporting members 130,132 to function as a fastening mechanism for mechanically fastening the filter 300 to the vent body 104. More specifically, the filter element 300 could be disposed beneath (e.g., from the perspective of FIG. 5) the elongated resilient members 130,132 such that the filter element 300 is captured between the elongated resilient members 130,132 and the inner surface 106 of the vent body 104 when the elongated resilient members 130,132 are coupled to the corresponding protrusions 126,128, respectively, as shown.

As best shown in the partially exploded view of FIG. 8, the sealing portion 148 of the example elongated resilient member 130 includes a plurality of sealing projections 154,156,158 (three are shown), which extend outwardly from the mounting portion 146, and are structured to be compressed against the exterior surface 202 of the roof 200, as previously described hereinabove (see also sealing projections 154',156',158' of elongated resilient member 132). More specifically, although not required, the elongated resilient element 130 is contemplated as being comprised of a dual durometer component wherein the mounting portion 146 is generally hard (e.g., without limitation, harder than the sealing portion 148), and the sealing portion 148 is generally soft (e.g., without limitation, softer than the mounting portion 146). This will enable the elongated resilient member 130 to maintain a generally straight shape within the corresponding channel 150 of the vent body 104, as shown in FIGS. 5 and 6, while simultaneously enabling the sealing projections 154',156',158' (e.g., without limitation, molded arms, ribs or legs) to compress, as desired, against the exterior surface 202 (e.g., without limitation, shingles 212) of the roof 200 to substantially fill in and seal spaces between the shingles 212 of the roof 200 and the vent 102.

Figure 2:
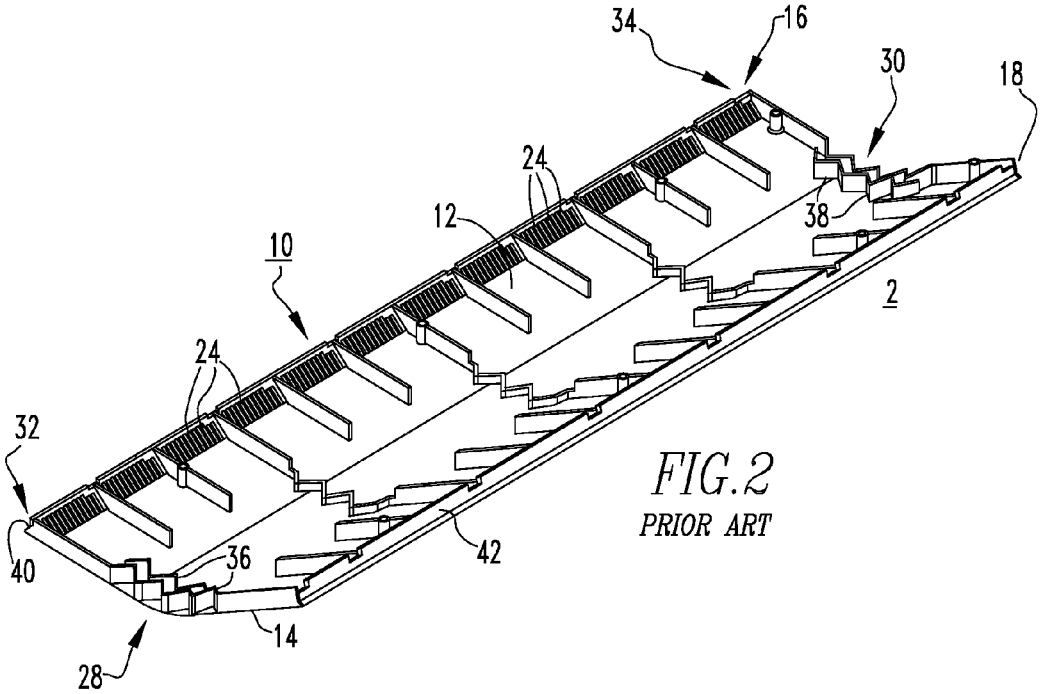
FIG.2 PRIOR ART
FIG. 2 is an isometric view of the underside of the ridge vent of FIG. 1.
Figure 3:
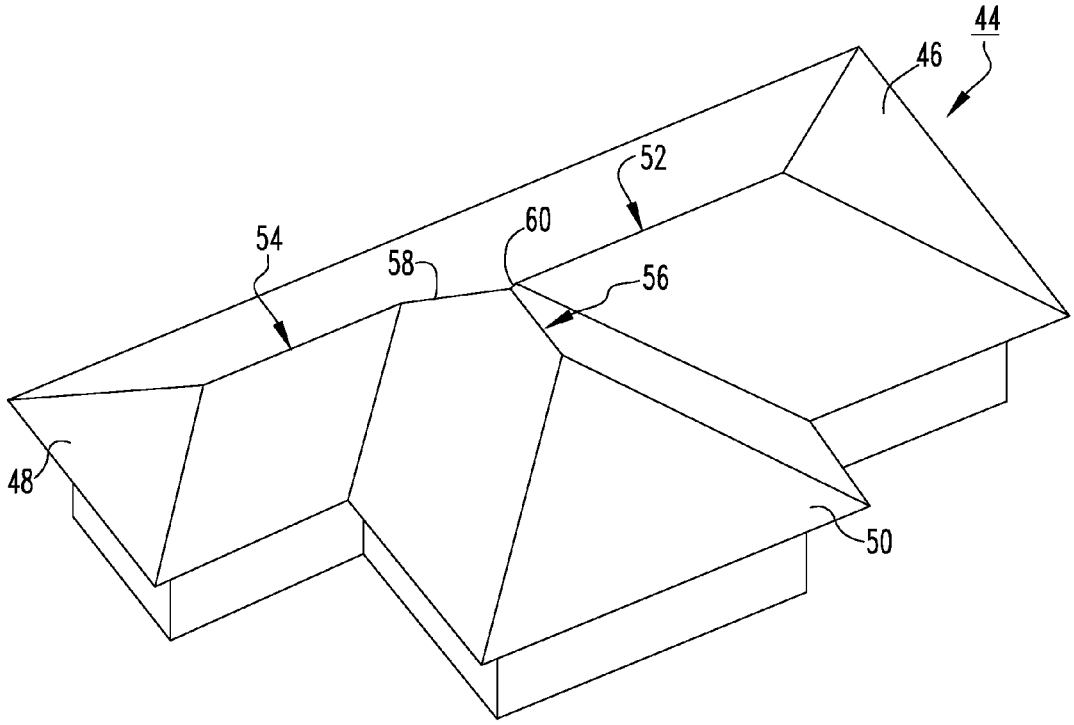
FIG. 3 PRIOR ART
FIG. 3 is a simplified isometric view of a non-limiting example of building having a hip style roof of the type with which the disclosed roof ridge vent can be employed.

The ability of the disclosed vent 102 to effectively seal uneven (e.g., rough; stepped; having a stair profile) surfaces 212 will be further appreciated with reference to the simplified illustration of FIG. 9, which shows the interaction of the elongated resilient element 130 of the vent 102 (not shown in FIG. 9 for simplicity of illustration) with the roof shingle 212. Specifically, in the example of FIG. 8, the exterior surface 202 of the shingle 212 includes a stair or stepped portion 214 having a relatively high or raised area 216, and a relatively low or recessed area 218 adjacent to the raised area 216. Such a stepped portion 214 would ordinarily result in an undesirable gap for conventional roof vents (see, for example, roof vent 2 of FIGS. 1 and 2), between the base of the vent 2 and the relatively low recessed area 218 of the shingle 212. However, the elongated resilient element 130 and, in particular, the sealing projections 154,156,158 (only sealing projection 154 is shown in FIG. 8 for simplicity of illustration) are compressible and extend beneath the bottom edge 134 of the vent body 104, as previously discussed, to address and substantially overcome this problem in order to form an effective seal. Specifically, a portion 160 of the sealing projection 154 can be compressed at locations where the exterior surface 202 of the roof 200 is relatively high or raised (see, for example, raised area 216), but may also extend into relatively low areas (see, for example, recessed area 218 of shingle 212). In other words, the portion 162 of the sealing projection 154 of the elongated resilient element 130 is uncompressed, or less compressed than compressed portion 160, such that the sealing projection(s) (only sealing projection 154 is shown) extend into the recessed area 218 of the roof shingle 212. In this manner, the elongated resilient element 130 forms an effective seal, substantially eliminating gaps or voids between the exterior surface 202 of the roof 200 and the vent 102. This is particularly useful in applications such as, for example and without limitation, hip style roofs of the type generally shown in FIG. 3, where the roof 44 has a variety of different ridgelines 52,54,56, some of which are disposed at angles (e.g., sloped portions 58,60 of FIG. 3) and therefore result in uneven (e.g., without limitation, rough; stepped; a stair profile) surfaces of the type generally shown in FIG. 9.

Accordingly, the disclosed vent 102 is readily employable with a wide variety of different roof types (e.g., without limitation, gable style; hip style; a combination of hips and gables) and roof finishing surfaces (e.g., without limitation, shingles) to provide an effective seal while establishing the desired ventilation of the roof 200.

FIG. 10 shows a portion of a protrusion 326 and an elongated resilient member 330 that may replace each of the aforementioned protrusions 126,128 and the corresponding elongated resilient members 130,132 in the vent 102, in accordance with a non-limiting alternative embodiment of the disclosed concept. In the example of FIG. 10, the elongated resilient member 330 includes a first elongated portion 332 and a second elongated portion 334. The second elongated portion 334 includes a first projection 336 and may optionally include a number of additional projections 338,340 (shown in phantom line drawing), each of which is structured to compress against and form a seal with the exterior surface of the roof 200 (partially shown in simplified form in phantom line drawing in FIG. 8; see also FIG. 9). In other words, the elongated resilient member 330 may have substantially the same shape and configuration as the elongated resilient members 130,132, previously discussed, but is preferably formed as part of (i.e., is integral with) the protrusion 326 such that the resultant vent 102' is made from one single unitary piece of material as shown in FIG. 10, and as will be described in greater detail hereinbelow. Of course, it will also be appreciated that the vent 102' and integral elongated resilient member 330 therefor could have any known or suitable alternative size, shape or configuration (not shown), without departing from the scope of the disclosed concept.

Continuing to refer to FIG. 10, the example first elongated portion 332 is integral with, and extends from, the protrusion 326, and the projections 336,338,340 extend from the first elongated portion 332. Thus, as seen in FIG. 10, there is no line separating the protrusion 326 from the first elongated portion 332, and no line separating the first elongated portion 332 from the projections 336,338,340. That is, the vent 102' is a single unitary component (e.g., without limitation, an injection molded piece). In other words, the protrusions 126,128 and the separate corresponding elongated resilient members 130,132 are replaced with the elongated resilient member 330, which is integral with the protrusion 326. Accordingly, manufacturing is advantageously simplified by eliminating the need to separately manufacture and subsequently attach the elongated resilient members 130,132 to the vent 102. In one non-limiting example, the first elongated portion 332 and corresponding integral protrusion 326 are preferably harder than the projections 336,338,340. Thus, the hardness of the elongated resilient member 330 may vary from the first elongated portion 332 to the projections 336,338,340. As a result, the projections 336,338,340 are better able to compress against and form a seal with the exterior surface of the roof 200. In other words, the vent 102' is formed (e.g., without limitation, injection molded; 3-D printed) as one single unitary piece, but may have sections or portions of different materials and/or different material properties (e.g., without limitation, hardness).

Furthermore, although the disclosed embodiment has been described in association with the protrusion 326 and the elongated resilient member 330 replacing each of the protrusions 126,128 and the corresponding elongated resilient members 130,132, it is within the scope of the disclosed concept for the protrusion 326 and the elongated resilient member 330 to replace only the protrusions 126 and the elongated resilient member 130 in the vent 102. That is, any desired portion(s), or alternatively all of the vent 102' and elongated resilient member 330 may be integrally formed as a common single unitary piece of material.

FIG. 11 shows a portion of a protrusion 426 and a sealing member 430 (shown in simplified form), for a vent 102", in accordance with an alternative embodiment of the disclosed concept. The sealing member 430 is preferably caulk, resin, or polyvinylchloride, each of which is a material that is able to advantageously provide a relatively strong sealing connection. It will be appreciated, however, that any known or suitable alternative material(s) could be employed to perform the desired sealing function.

Continuing to refer to FIG. 11, the protrusion 426 includes an inner edge 440 that is structured to be located at or about the inner surface 106 (FIGS. 5 and 6) of the vent body 104, and an outer edge 442 located opposite the inner edge 440. The outer edge 442 may include a portion having a cutout 444, as shown (or any other suitable configuration). The sealing member 430 sealingly engages the portion of the outer edge 442 at or about the cutout 444, advantageously providing a relatively secure connection between the sealing member 430 and the protrusion 426. Furthermore, the sealing member 430 is structured to compress against and form a seal with the exterior surface of the roof 200 (partially shown in simplified form in phantom line drawing in FIG. 8; see also FIG. 9), thus providing a relatively secure connection and seal between the exterior surface of the roof 200 and the protrusion 426.

Additionally, when the sealing member 430 is used in place of each of the aforementioned elongated resilient members 130,132, the sealing member 430 preferably extends longitudinally between the first end 110 and the second end 112 of the vent body 104. However, it is within the scope of the disclosed concept to have sealing members not extend longitudinally between the first end 110 and the second end 112, such as, for example and without limitation, isolated individual sealing members (not shown) located only at locations where a protrusion (e.g., the protrusion 426) intersects the roof 200, or at any other desired location(s) or portion(s) of the vent 102". It is also within the scope of the disclosed concept for the sealing member 430 to replace only one of the aforementioned elongated resilient members 130,132.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A vent for a roof including an exterior surface, said vent comprising:

a body comprising an inner surface structured to face said roof, an outer surface disposed opposite the inner surface, a first end, a second end disposed opposite and distal from the first end, a first side, and a second side disposed opposite and distal from the first side;

a first edge portion disposed at or about the first side and including a plurality of first openings for the passage of air;

a second edge portion disposed at or about the second side and including plurality of second openings for the passage of air;

a plurality of protrusions extending outwardly from the inner surface of said body; and a plurality of elongated resilient members extending longitudinally between the first end and the second end, each of said elongated resilient members extending from a corresponding number of said protrusions, wherein said elongated resilient members are structured to compress against the exterior surface of said roof, thereby forming a seal between said vent and said roof, and wherein said vent is a single unitary component.

2. The vent of claim 1 wherein each of said elongated resilient members comprises a first elongated portion and a second elongated portion; wherein each of said first elongated portion and said second elongated portion extends longitudinally between the first end and the second end; and wherein the first elongated portion is harder than the second elongated portion.

3. The vent of claim 2 wherein said single unitary component is an injection molded piece.

4. The vent of claim 2 wherein said first elongated portion extends from the corresponding number of said protrusions; wherein said second elongated portion comprises a number of projections extending outwardly from said first elongated portion; and wherein each of said number of projections is structured to compress against the exterior surface of said roof.

5. The vent of claim 2 wherein said plurality of protrusions is a first number of protrusions and a second number of protrusions; wherein each of said first number of protrusions extends laterally inwardly from said first edge portion toward said second edge portion; wherein each of said second number of protrusions extends laterally inwardly from said second edge portion toward said first edge portion; wherein each of said elongated resilient members extends perpendicularly across a corresponding one of said first number of protrusions and said second number of protrusions; wherein said number of elongated resilient members is a first elongated resilient member and a second elongated resilient member; wherein said first elongated resilient member extends from each of said first number of protrusions; wherein said second elongated resilient member extends from each of said second number of protrusions, substantially parallel with respect to said first elongated resilient member; wherein said first elongated resilient member is spaced from the inner surface of said body thereby forming a number of first gaps for airflow to said plurality of first openings; and wherein said second elongated resilient member is spaced from the inner surface of said body thereby forming a number of second gaps for airflow to said plurality of second openings.

6. A vent for a roof including an exterior surface, said vent comprising:

a body comprising an inner surface structured to face said roof, an outer surface disposed opposite the inner surface, a first end, a second end disposed opposite and distal from the first end, a first side, and a second side disposed opposite and distal from the first side;

a first edge portion disposed at or about the first side and including a plurality of first openings for the passage of air;

a second edge portion disposed at or about the second side and including plurality of second openings for the passage of air;

a plurality of protrusions extending outwardly from the inner surface of said body; and a plurality of sealing members structured to compress against the exterior surface of said roof, thereby forming a seal between said vent and said roof, and wherein each of said sealing members sealingly engages a corresponding number of said protrusions.

7. The vent of claim 6 wherein said corresponding number of protrusions is a plurality of transverse supporting members each including an inner edge disposed at or about the inner surface of said body, and an outer edge disposed opposite and spaced apart from the inner edge; wherein each outer edge includes a portion having a cutout; and wherein each of said sealing members sealingly engages at least one said portion at or about said cutout.

8. The vent of claim 7 wherein each of said sealing members is made of a material selected from the group consisting of caulk and resin.

9. The vent of claim 7 wherein each of said sealing members extends longitudinally between the first end and the second end.

10. The vent of claim 9 wherein said plurality of protrusions is a first number of protrusions and a second number of protrusions; wherein each of said first number of protrusions extends laterally inwardly from said first edge portion toward said second edge portion; wherein each of said second number of protrusions extends laterally inwardly from said second edge portion toward said first edge portion; wherein each of said sealing members extends perpendicularly across a corresponding one of said first number of protrusions and said second number of protrusions; wherein said plurality of sealing members is a first sealing member and a second sealing member; wherein said first sealing member sealingly engages each of said first number of protrusions; wherein said second sealing member sealingly engages each of said second number of protrusions, substantially parallel with respect to said first sealing member; wherein said first sealing member is structured to be spaced from the inner surface of said body thereby forming a number of first gaps for airflow to said plurality of first openings; and wherein said second sealing member is structured to be spaced from the inner surface of said body thereby forming a number of second gaps for airflow to said plurality of second openings.

11. A ventilated roof comprising:

a substructure including a substantially flat layer;

at least one ridgeline including a ventilation opening;

a plurality of shingles attached to said substantially flat layer; and at least one vent overlaying said ventilation opening, said at least one vent comprising:

a body comprising an inner surface facing said roof, an outer surface disposed opposite the inner surface, a first end, a second end disposed opposite and distal from the first end, a first side, and a second side disposed opposite and distal from the first side;

a first edge portion disposed at or about the first side and including a plurality of first openings for the passage of air;

a second edge portion disposed at or about the second side and including plurality of second openings for the passage of air;

a plurality of protrusions extending outwardly from the inner surface of said body; and a plurality of elongated resilient members extending longitudinally between the first end and the second end, each of said elongated resilient members extending from a corresponding number of said protrusions, wherein said elongated resilient members compress against said shingles, thereby forming a seal between said shingles and said at least one vent, and wherein said at least one vent is a single unitary component.

12. The roof of claim 11 wherein each of said elongated resilient members comprises a first elongated portion and a second elongated portion; wherein each of said first elongated portion and said second elongated portion extends longitudinally between the first end and the second end; and wherein the first elongated portion is harder than the second elongated portion.

13. The roof of claim 12 wherein said single unitary component is an injection molded piece.

14. The roof of claim 12 wherein said first elongated portion extends from the corresponding number of said protrusions; wherein said second elongated portion comprises a number of projections extending outwardly from said first elongated portion; and wherein each of said number of projections is structured to compress against the exterior surface of said roof.

15. The roof of claim 12 wherein said plurality of protrusions of said at least one vent is a first number of protrusions and a second number of protrusions; wherein each of said first number of protrusions extends laterally inwardly from said first edge portion of said at least one vent toward said second edge portion; wherein each of said second number of protrusions extends laterally inwardly from said second edge portion of said at least one vent toward said first edge portion; wherein each of said elongated resilient members extends perpendicularly across a corresponding one of said first number of protrusions and said second number of protrusions; wherein said number of elongated resilient members of said at least one vent is a first elongated resilient member and a second elongated resilient member disposed substantially parallel with respect to said first elongated resilient member; wherein said first elongated resilient member extends longitudinally across said first number of protrusions on one side of said ridgeline; wherein said second elongated resilient member extends longitudinally across said second number of protrusions on the other side of said ridgeline; wherein said first elongated resilient member is spaced from the inner surface of said body thereby forming a number of first gaps for airflow from said ventilation opening to said plurality of first openings of said at least one vent; and wherein said second elongated resilient member is spaced from the inner surface of said body thereby forming a number of second gaps for airflow from said ventilation opening to said plurality of second openings of said at least one vent.

16. A ventilated roof comprising:

a substructure including a substantially flat layer;

at least one ridgeline including a ventilation opening;

a plurality of shingles attached to said substantially flat layer; and at least one vent overlaying said ventilation opening, said at least one vent comprising:

a body comprising an inner surface facing said roof, an outer surface disposed opposite the inner surface, a first end, a second end disposed opposite and distal from the first end, a first side, and a second side disposed opposite and distal from the first side;

a first edge portion disposed at or about the first side and including a plurality of first openings for the passage of air;

a second edge portion disposed at or about the second side and including plurality of second openings for the passage of air;

a plurality of protrusions extending outwardly from the inner surface of said body; and a plurality of sealing members compressed against the exterior surface of said roof, thereby forming a seal between said vent and said roof, and wherein said sealing members compress against said shingles, thereby forming a seal between said shingles and said at least one vent, and wherein each of said sealing members sealingly engages a corresponding number of said protrusions.

17. The roof of claim 16 wherein said corresponding number of protrusions is a plurality of transverse supporting members each including an inner edge disposed at or about the inner surface of said body, and an outer edge disposed opposite and spaced apart from the inner edge; wherein each outer edge includes a portion having a cutout; and wherein each of said sealing members sealingly engages at least one said portion at or about said cutout.

18. The roof of claim 17 wherein each of said sealing members is made of a material selected from the group consisting of caulk and resin.

19. The roof of claim 17 wherein each of said sealing members extends longitudinally between the first end and the second end.

20. The roof of claim 19 wherein said plurality of protrusions of said at least one vent is a first number of protrusions and a second number of protrusions; wherein each of said first number of protrusions extends laterally inwardly from said first edge portion of said at least one vent toward said second edge portion; wherein each of said second number of protrusions extends laterally inwardly from said second edge portion of said at least one vent toward said first edge portion; wherein each of said sealing members extends perpendicularly across a corresponding one of said first number of protrusions and said second number of protrusions; wherein said plurality of sealing members of said at least one vent is a first sealing member and a second sealing member disposed substantially parallel with respect to said first sealing member; wherein said first sealing member extends longitudinally across said first number of protrusions on one side of said ridgeline; and wherein said second sealing member extends longitudinally across said second number of protrusions on the other side of said ridgeline; wherein said first sealing member is spaced from the inner surface of said body thereby forming a number of first gaps for airflow from said ventilation opening to said plurality of first openings of said at least one vent; and wherein said second sealing member is spaced from the inner surface of said body thereby forming a number of second gaps for airflow from said ventilation opening to said plurality of second openings of said at least one vent.

* * * * *